United States Patent [19]

Lininger

[11] Patent Number: 4,550,844

[45] Date of Patent: Nov. 5, 1985

[54] TAMPER RESISTANT CLOSURE WITH TEAR-OFF BAND

[75] Inventor: Michael A. Lininger, Toledo, Ohio

[73] Assignee: Owens-Illinois, Inc., Toledo, Ohio

[21] Appl. No.: 623,659

[22] Filed: Jun. 22, 1984

[51] Int. Cl.[4] ..... B65D 41/34
[52] U.S. Cl. ..... 215/252
[58] Field of Search ..... 215/252

[56] References Cited

U.S. PATENT DOCUMENTS 4,394,918 7/1983 Grussen ..... 215/252
4,488,655 12/1984 Itsubo et al. ..... 215/252

FOREIGN PATENT DOCUMENTS 2421812 12/1979 France ..... 215/252

*Primary Examiner*—Donald F. Norton
*Attorney, Agent, or Firm*—John R. Nelson

[57] ABSTRACT

A tamper resistant closure for a finish of a container. The closure has an annular skirt with an annular tamper indicating band integrally attached thereto with a plurality of frangible bridges. The band has preferably a plurality of wedge-shaped tabs that contact the container finish and bend upwardly when the closure is applied to the container. When there is an attempt to remove the closure, the thicker outer portion of the tab wedges against the container finish to apply torque to the band and break the bridges to leave the pilfer indicating band on the container.

16 Claims, 6 Drawing Figures

TAMPER RESISTANT CLOSURE WITH TEAR-OFF BAND

The present invention relates to a tamper resistant or pilfer resistant closure with a tear-off band to indicate tampering before the ultimate user or consumer opens the closure and the container associated therewith.

BACKGROUND OF THE INVENTION

Tamper resistant closures for finishes of containers have been disclosed, such closures having tear-off bands that are broken away from the main portion of the closure by frangible bridges when the closure is removed from the container.

Such closures for containers are disclosed in U.S. Pat. No. 4,394,918 to Grussen; U.K. 2,022,063; U.K. 1,265,008, 3/1972; U.K. 2,033,350, 5/1980; German DE 30 25 751 Al; French 2,290,114; French 2,241,812, and French 2,490,598.

U.S. Pat. No. 4,394,918 (Grussen), apparently more pertinent to the present invention than the others, discloses a screw cap for a finish of a container, the cap having a depending skirt with an annular tamper indicating band connected by frangible bridges 4 connected thereto. The band has a plurality of tabs or lock-lugs 7 that bend like fishhooks and contact the finish of the container just below the collar 13 of the container neck. The lock-lugs contact the container finish so that when the screw cap is turned for removal, shearing forces cause the bridge 4 to break and leave the band on the container, the lock-lugs 7 being able to resist the compression and shearing forces. When first molded, the lock-lugs 7 are said to be inclined downwardly from the band at an angle (alpha) of about 120° to 140° and when the cap is screwed on the container, the lugs bend to define an acute angle (beta) of, for instance, 40° to 60°.

OBJECTS OF THE INVENTION

It is an object of the present invention to provide a tamper resistant closure for a finish of a container, the closure having an annular tear-off band integrally molded to a main skirt portion of the closure by means of frangible bridges, there being preferably a plurality of tabs that are wedge-shaped, the thicker outer portion of each tab being wider and thicker than the rest of the tab for contact of the tab outer end with the container finish, the tab bending upwardly like a fishhook to secure the tab in its operating tamper indicating position when the closure is applied to the container.

It is an object of the present invention to provide a closure in combination with a container having a finish with a neck ring including an annular finish bead, the closure comprising a cap and a tamper resistant member connected to the cap with a series of frangible break-away bridges that attach the tamper resistant member to the cap, the member comprising an annular band integral with the bridges a plurality of wedge-shaped glass finish contacting flanges that bend upwardly like a fishhook when the cap is applied to the finish, the flanges contacting the glass container finish above the annular bead, there being interference between the bead and the flanges when the cap is loosened whereby torque is applied to the bridges by the contact of the wedges and the container finish, there being an angle of about 45° to 90° between the horizontal and the upper part of the flange.

It is an object of the present invention to provide novel improved tabs used with an annular tamper indicating band in a closure construction, the band integrally connected to the depending closure skirt by frangible bridges, the tabs being so constructed and arranged that they bend like fishhooks with the closure is applied and provide more contact against the neck finish of a container and more torque against the bridges when the closure is removed whereby the bridges break and the band is left around the neck of the container clearly indicating a closure removal or removal attempt.

These and other objects will be apparent from the specification that follows, the appended claims, and the drawings, in which:

Figure 1:
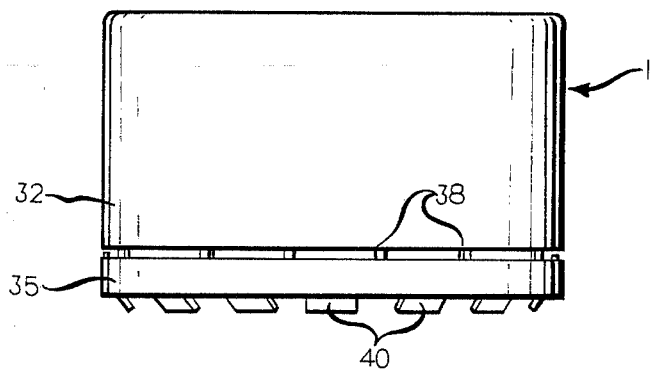
FIG. 1 is a side elevational perspective view of the cap with its tamper indicating band provided with tabs according to the present invention.

The present invention provides a tamper resistant closure for a finish of a container, the closure having a depending skirt portion and connected thereto by frangible bridges an annular tamper indicating band provided with novel wedge-shaped tabs that bend upwardly like fishhooks when the closure is put on and which wedge against the finish to apply torque that breaks the bridges when the closure is removed.

The present invention provides a pilfer resistant closure of a finish of a container having a neck ring, the closure comprising a cap and an annular tamper resistant band member connected to the bottom of the cap with a series of frangible break-away bridges that attach the tamper resistant band member to the cap, the member comprising an annular band integral with the bridges and a lower wedge-shaped glass-finish contacting member that bends upwardly like a fishhook when the cap is applied to the finish, the outer end portion of the contacting member being wider and thicker than the portion nearer the band for greater contact of the end portion against the neck ring of the glass finish.

As seen in the drawings, there is provided a closure 1 in combination with a container 10 having a finish 15 with a neck ring 20 including an annular finish bead 22. The closure or cap 1 has a top 30 with a main depending skirt portion 32. There is provided cap skirt threads 33 and a top cap sealing ring 34. A tamper resistant band member 35 is connected to the cap skirt 32 with a series of frangible bridges 38 that are designed to break when the closure is removed or partly opened in an attempt to remove the same. The break-away band member 35 has integrally connected therewith generally a plurality of wedge-shaped glass-contacting tabs or flanges 40 that bend like fishhooks when the closure is tightened on the container. The outer wedge portion 45 is larger, being wider and generally thicker, than the rest of the tab 40 including the portion 48 next to the band 35. The outer tab portion, when the closure is applied to the container, contacts and wedges against the finish 15 above the annular bead 22. When attempting to remove the closure, there is interference between the container bead and tabs 40 whereby torque is applied to the band 35 and bridges 38 resulting in breaking the bridges to indicate the closure has been loosened enough to break the bridges and have the tamper indicating band 35 remain on the container.

As seen in the drawings, the outer portion 45 of the tab 40 is generally $1\frac{1}{4}$ to 2 or 3 times as wide and as thick as the thinner portion 48. Preferably the width of the wide portion 45 is about 1.8 to 2.2 times the width of the thinner portion 48.

Figure 2:
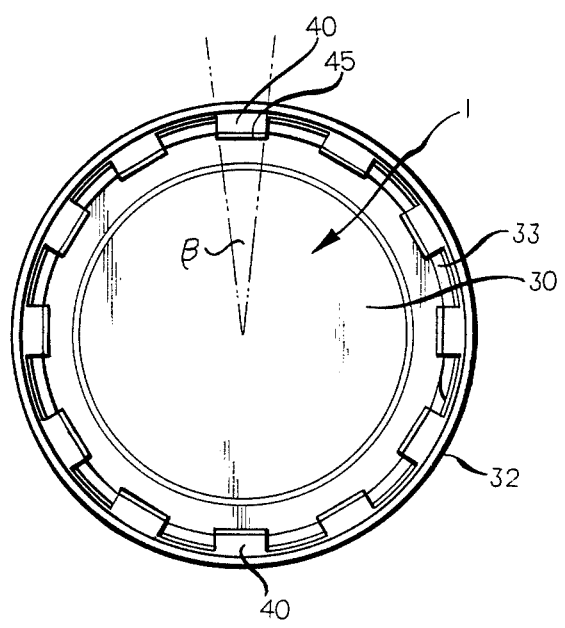
FIG. 2 is a bottom plan view of the cap of FIG. 1.

As shown in FIG. 2, the tabs depend from the skirt periphery. The angle beta that subtends one of the tabs is from about 10° to 360° depending on the size and design of the cap. With a small cap beta would be greater than about 20° and, with a large cap, beta would be about 10° or more.

Figure 6:
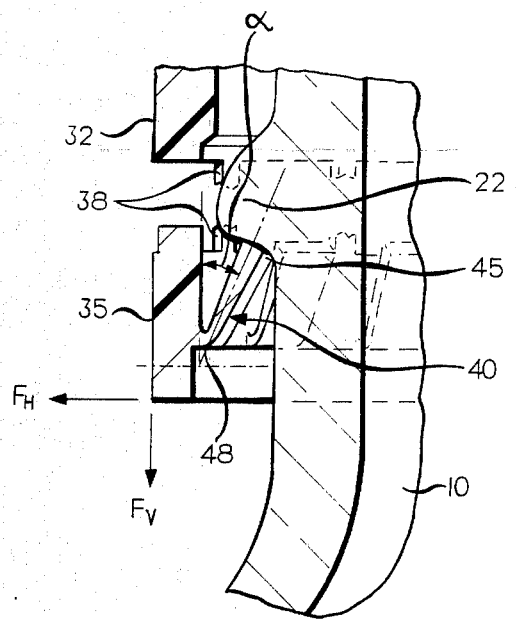
FIG. 6 shows the cap and container as in FIG. 3 in its final tightened position with the tabs bent like fishhooks contacting the container finish, the bridges being broken to show the band as a tamper indicating band.
Figure 3:
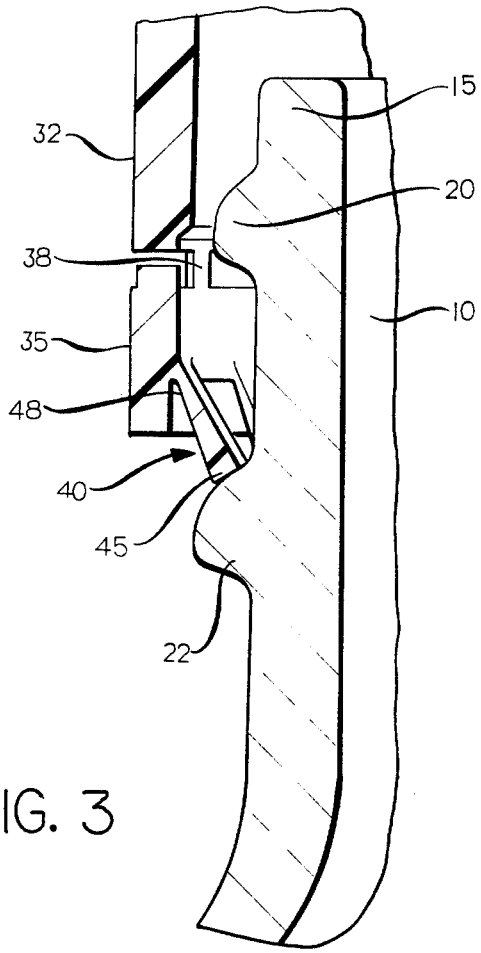
FIG. 3 is an enlarged sectional view of the lower skirt, annular band and depending tabs of the closure of FIG. 1 being applied, in the initial stage, to a finish of a container.
Figure 4:
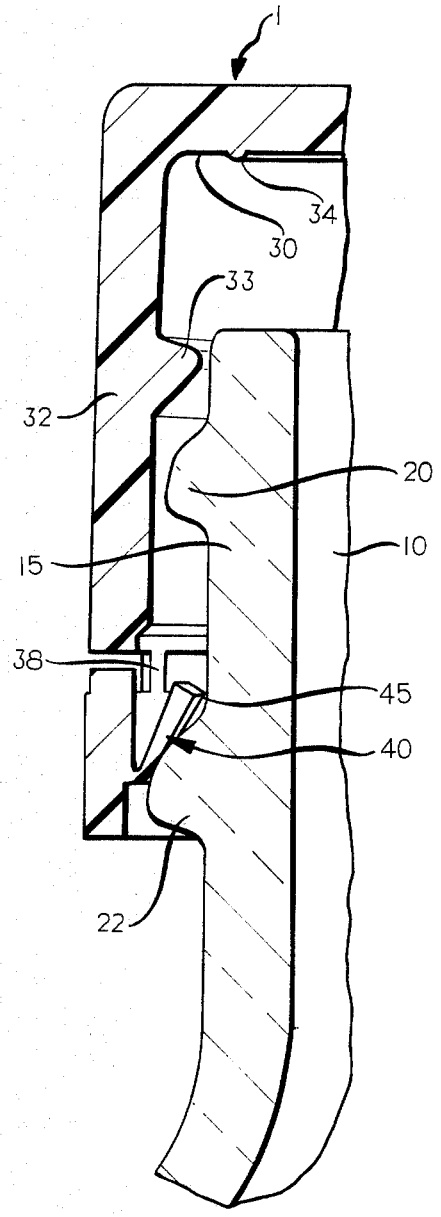
FIG. 4 is an enlarged sectional view of the cap and container of FIG. 3, the cap being applied a little farther down the container finish.
Figure 5:
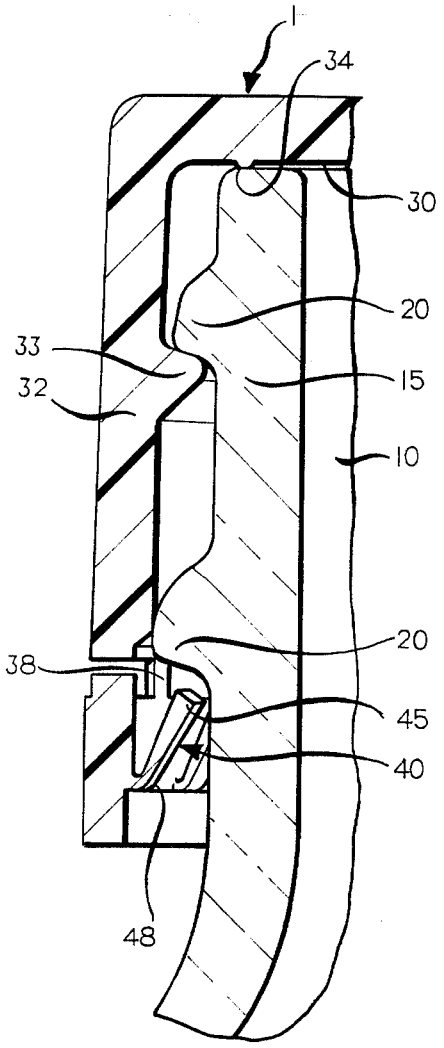
FIG. 5 shows the cap and closure of FIG. 4 with the cap being in or nearly in its tightened position.

The annular band is to function as an annular ring carrying at its outer periphery stiff tab members oriented inwardly and upwardly on a rigid plastic closure. The purpose of the band and tabs is to overcome the tensile strength of frangible break-away bridges which join a tamper resistant member to its closure. The annular band will function properly when generally the tabs are oriented within an upward angle between 45° and 90° from the horizontal as long as contact with the lower glass finish bead is made. The upward angle, alpha, is shown in FIG. 6. It is also advantageous to limit the neck of the container to a diameter which will be approximately that diameter of the annular bead at its 45° position. This will assure that the vertical forces on the bridges will be equal to or greater than the horizontal forces.

With a condition where the rigid annular band is at 45°, vertical forces ($F_V$) and horizontal forces ($F_H$) are in equilibrium. The vector forces $F_V$ and $F_H$ are shown in FIG. 6. Since the cross sectional area of the annular band is many times greater (say, 10 to 100 times or more) than that of the frangible break-away bridges, deformation or breakage of the bridges will occur as the closure is removed from its container. Also, the tensile strength for the bridges is smaller than the compressive strength of the annular band when a comparison of cross sections is made.

Angles between 45° and 90° from the horizontal for the upwardly oriented tabs will take the forces out of equilibrium. The greater the angle becomes, the greater the vertical forces become; thus, making the vertical forces over-ride the horizontal forces until there are little or no more horizontal forces.

Assuming the annular band and the tabs to be 89 or 90° from the horizontal and with slight interference between the glass finish bead and the annular band, vertical forces overcome the tensile strength of the bridges causing the bridges to break-away upon cap removal from its container.

The most ideal angle for the upwardly bent tabs of the annular band is found between 60° and 75° from the horizontal since this will assure contact of the annular band and tabs to the glass finish bead and a substantial vertical force to maximize the condition to break the frangible bridges adjoining the tamper resistant member to its closure.

The preferred cap construction has about 6 to 10 tabs and preferably about 8. The length of each tab is generally about $\frac{3}{4}$ to $1\frac{1}{2}$ times the width of the annular band. The width of the wide portion 45 of the tab is generally about 1.5 to 2.5 times and preferably about twice the width of the thin portion 48, but the width of 45 is only about $\frac{1}{8}$ to $\frac{1}{3}$ that of the width of the annular band. The thickness of the portion 45 is generally about $\frac{3}{4}$ to 9/10 that of the thickness of the annular band. As seen in the drawings, the width and thickness of the frangible bridges are much less than the thinner portion 48 of the tab.

What is claimed is:

1. A closure for a finish of a container having a neck ring, the closure comprising a cap and an annular tamper resistant band member connected to the bottom of the cap with a series of frangible break-away bridges that attach the tamper resistant band member to the cap, the member comprising an annular band integral with the bridges and a lower wedge-shaped glass-finish contacting member that bends upwardly like a fishhook when the cap is applied to the finish, the outer end portion of the contacting member being wider and thicker than the portion nearer the band for greater contact of the end portion against the neck ring of the glass finish.

2. A closure as defined in claim 1 in which the glass contacting member is an annular flange molded at a downward angle to the band and adapted to bend upwardly and behind the skirt of the cap to contact a lower bead of the glass finish to provide means for the member to grasp the bead and glass finish even when the bridges are broken to indicate the closure has been tampered with.

3. A closure as defined in claim 1 in which the member is a plurality of circumferentially disposed gripping tabs molded at an angle to the band, the tabs bending upwardly around a bead on the glass finish where the closure is secured on the container, the outer end portion of each of the tabs contacting the underside of the neck ring of the glass finish and holding the band and tabs on the glass finish even when the bridges are broken.

4. A closure as defined in claim 3 in which each of the tabs has a thin portion near the band, the tab tapering gradually to the thicker and wider contacting end portion.

5. A closure as defined in claim 3 in which the width of the outer contacting portion of the tabs is about $\frac{1}{8}$ to $\frac{1}{3}$ the length of the tab.

6. A closure as defined in claim 3 in which the bridges are made by an annular score line at the bottom of the cap.

7. A closure as defined in claim 3 in which the bridges are made by molding at the bottom of the cap.

8. A closure as defined in claim 1 in which the member is bent upwardly at an angle of about 5° to 85° with the horizontal when the cap is applied to the container.

9. A closure as defined in claim 1 in which the outer contacting portion of the member is about $1\frac{1}{2}$ to 4 times the width of the rest of the portion connected to the band.

10. A closure as defined in claim 1 in which the outer contacting portion is wider and thicker than the middle portion of the wedge-shaped contacting member.

11. A closure as defined in claim 1 in which there are 6 to 10 wedge-shaped contacting members.

12. A closure in combination with a container having a finish with a neck ring including an annular finish bead, the closure comprising a cap and a tamper resistant member connected to the cap with a series of frangible break-away bridges that attach the tamper resistant member to the cap, the member comprising an annular band integral with the bridges a plurality of wedge-shaped glass finish contacting flanges that bend upwardly like a fishhook when the cap is applied to the finish, the flanges contacting the glass container finish above the annular bead, there being interference between the bead and the flanges when the cap is loosened whereby torque is applied to the bridges by the contact of the wedges and the container finish, there being an angle of about 45° to 90° between the horizontal and the upper part of the flange, each flange having an outer end portion that contacts the container finish, each end portion being wider and thicker than the rest of the wedge shaped flange, the end portion being about 1¼ to 3 times as wide and as thick as the portion of the flange connected to the annular band.

13. A closure as defined in claim 12 in which the angle between the horizontal and the flange is about 60° to 75°.

14. A closure as defined in claim 12 in which beta is an angle subtending two radii of the cap in the top plan view, the angle beta defining a tab at the closure periphery, the tab being thinnest at the periphery, beta being an angle from about 10° to 360°.

15. A closure as defined in claim 14 in which beta is at least about 20°.

16. A closure as defined in claim 12 in which there are 8 wedge-shaped flanges.

* * * * *